US010119333B2

(12) United States Patent
Bullin

(10) Patent No.: US 10,119,333 B2
(45) Date of Patent: Nov. 6, 2018

(54) DOWNHOLE MOTOR

(71) Applicant: Keith A. Bullin, Bryan, TX (US)

(72) Inventor: Keith A. Bullin, Bryan, TX (US)

( * ) Notice: Subject to any disclaimer, the term of this patent is extended or adjusted under 35 U.S.C. 154(b) by 682 days.

(21) Appl. No.: 14/604,177

(22) Filed: Jan. 23, 2015

(65) Prior Publication Data

US 2015/0129314 A1 May 14, 2015

Related U.S. Application Data

(63) Continuation of application No. 12/996,677, filed as application No. PCT/US2009/003505 on Jun. 11, 2009, now Pat. No. 8,967,299.

(51) Int. Cl.

| | |
|---|---|
| ***E21B 4/00*** | (2006.01) |
| ***E21B 7/06*** | (2006.01) |
| ***E21B 3/00*** | (2006.01) |
| ***E21B 4/02*** | (2006.01) |

(52) U.S. Cl.

CPC ..... *E21B 4/003* (2013.01); *E21B 3/00* (2013.01); *E21B 4/006* (2013.01); *E21B 4/02* (2013.01); *E21B 7/068* (2013.01)

(58) Field of Classification Search

CPC . E21B 3/00; E21B 4/003; E21B 4/006; E21B 4/02; E21B 7/068

USPC ..... 175/107, 73, 61

See application file for complete search history.

(56) References Cited

U.S. PATENT DOCUMENTS

| | | | | |
|---|---|---|---|---|
| 2,937,008 | A | 5/1960 | Whittle | |
| 3,112,801 | A | 12/1963 | Wallace et al. | |
| 3,260,318 | A | 7/1966 | Neilson et al. | |
| 3,894,818 | A | 7/1975 | Tschirky | |
| 4,029,368 | A | 6/1977 | Tschirky et al. | |
| 4,397,619 | A | 8/1983 | Alliquander | |
| 5,267,398 | A | 12/1993 | Hall | |
| 5,785,509 | A * | 7/1998 | Harris | E21B 4/02 166/312 |
| 6,349,778 | B1 | 2/2002 | Blair et al. | |
| 6,488,103 | B1 | 12/2002 | Dennis et al. | |
| 6,629,571 | B1 | 10/2003 | Downie | |
| 7,842,111 | B1 * | 11/2010 | Sani | F16C 33/26 175/374 |
| 2002/0195278 | A1 | 12/2002 | Vandenberg et al. | |
| 2007/0125578 | A1 | 6/2007 | McDonald et al. | |

FOREIGN PATENT DOCUMENTS

| | | |
|---|---|---|
| SU | 1657583 | 6/1991 |
| WO | WO88/01701 | 3/1988 |
| WO | WO91/19072 | 12/1991 |
| WO | WO2008015402 | 2/2008 |

* cited by examiner

*Primary Examiner* — Caroline N Butcher

(74) *Attorney, Agent, or Firm* — Bushman Werner, P.C.

(57) ABSTRACT

A downhole motor having a motor section, a drive shaft section, and an output shaft section. The output shaft section has a rotatable output shaft with a first end and a second end. A first thrust bearing assembly proximal to the first end of the output shaft, a second thrust bearing assembly proximal to second end to said output shaft. A radial bearing assembly disposed between the first and second thrust bearing assemblies.

13 Claims, 5 Drawing Sheets

12A
36
34
32
30
16
18
12B 10
12
28
24
12C
26
20
20A
22
20B
14

30
36
34
32
16
18
44
42
40
46
24
26
20
22
14

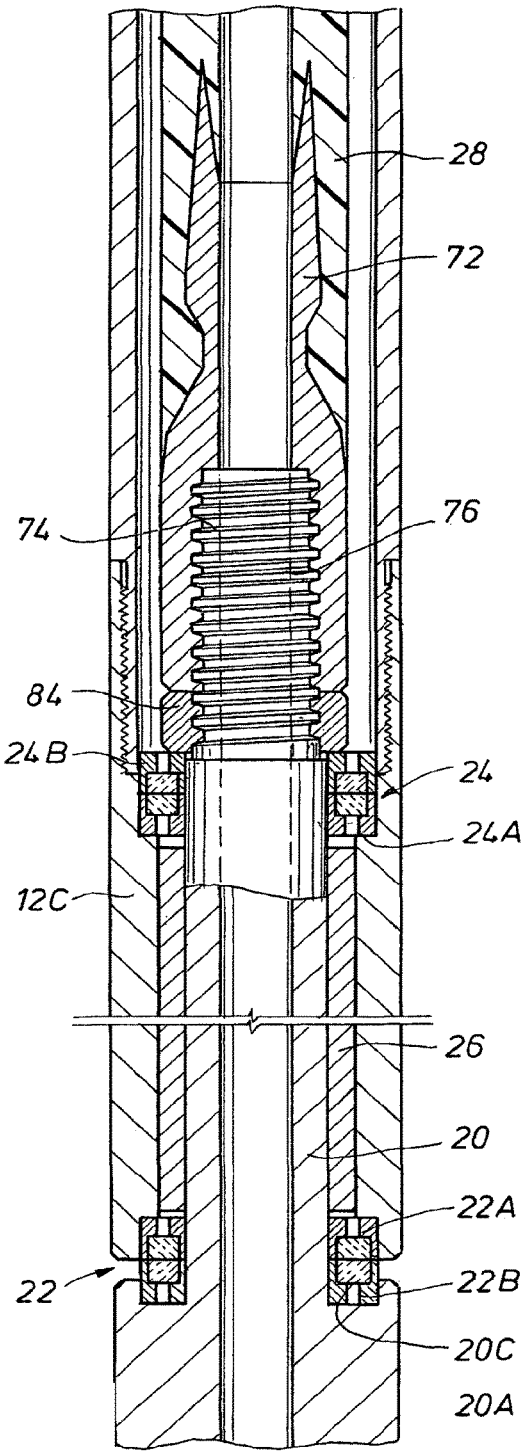
FIG. 3C
FIG. 4
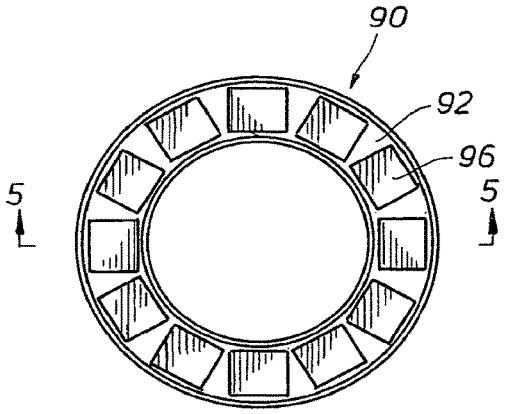
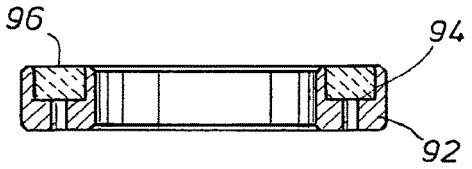
FIG. 5

DOWNHOLE MOTOR

CROSS REFERENCE TO RELATED APPLICATION

This application is a continuation of U.S. application Ser. No. 12/996,677 filed on Mar. 10, 2011, which is a U.S. National application of PCT/US2009/003505, filed Jun. 11, 2009, which claims priority to U.S. Application No. 61/060,529, filed on Jun. 11, 2008 the disclosures of which are all incorporated herein by reference for all purposes.

FIELD OF THE INVENTION

The present invention relates to downhole motors and, more particularly, to a bearing assembly for use in such motors, especially of the kind used for the drilling of oil and gas wells and other boreholes.

BACKGROUND OF THE INVENTION

Downhole or drilling motors, e.g., mud motors, are commonly used in the drilling industry to increase penetration rates and drill complex geometries such as directionally and horizontally. Mud motors work by removing energy from the drilling fluid using a Moineau pump in reverse. This energy is transferred from the drilling fluid to the rotation of a rotor inside the Moineau pump. The rotor is connected through a series of housings and bearings to the bit.

One of the most important parts of the downhole motor assembly is the lower end which houses the bearings. Bearings are required to support the inner rotating output shaft connected to the motor against the outer housing. Thrust bearings are used to support the drilling load. These bearings can be roller bearings with balls, tapered bearings with cylindrical rollers, or flat wear surfaces made of a hardened material such as a diamond surface. Mud motors also require radial bearings to support the side loads placed on the driveshaft. These bearings can be needle roller bearings or wear sleeves with hardened materials such as tungsten or diamond. There are two basic types of Moineau type motors in the industry: mud lubricated and sealed bearing. These two types differ by the mechanism to cool and lubricate the bearings.

Oil Sealed Mud Motors—Oil sealed mud motors contain seals around the bearing pack to maintain the bearings in an oil bath. This allows the bearings to remain lubricated and cooled with oil. Oil sealed motors also shield the bearings from the grit. The primary oil seals must compensate for the pressure difference between the surface and downhole conditions which may be many thousands of psi. As a result, these seals often slide on a piston to compensate. One of the major drawbacks of sealed bearing assemblies is the fact that they have a limited life once a seal loses its integrity.

Mud Lube Mud Motors—Mud lube motors have no sealing mechanism around the bearing assembly. These bearing assemblies bypass a fraction of the drilling fluid from the bit to lubricate and cool the bearings. Mud lube bearings commonly utilize hardened balls and races for thrust and tungsten coated sleeves to carry the radial load. Some designs incorporate manufactured diamond thrust and radial bearings. They are designed to withstand the grit and impurities in the mud system. The major drawback to mud lubed motors are limits to the service life due to the abrasive environment.

The drive shaft of a mud motor connects the rotor from the power section to an output shaft in the bearing section.

This driveshaft is a complex device because it must compensate for the eccentric motion of the rotor as well as, in certain cases, bend through a bent housing in a small space. Commonly, mud motors utilize two bending joints in the driveshaft—one at the connection to the rotor, and one at the bend in the housing. These bending joints can be U-joints, jaw clutch type joints, or CV-joints.

Mud motors operate in extremely harsh, highly abrasive downhole environments. With the high costs associated with drilling wells, it is extremely advantageous to increase mud motor efficiency and life. Since mud motors are composed of many parts, their life expectancy is only as good as the weakest link. To illustrate the current complexity of mud motors, reference is made to U.S. Pat. No. 6,827,160, the disclosure of which is incorporated herein for all purposes.

SUMMARY OF THE INVENTION

In accordance with one aspect of the present invention, there is provided a downhole motor assembly wherein thrust forces experienced at the output end of the downhole motor assembly are separated by a single radial bearing assembly, thereby significantly reducing the length of the output end of the downhole motor.

In accordance with another aspect of the present invention, there is provided a downhole motor assembly comprising a motor section, a drive shaft section, and an output shaft section. The output shaft section, includes a bearing assembly, comprised of first and second, axially spaced thrust bearing assemblies and an intermediate radial bearing assembly.

In a further aspect of the present invention, there is provided a bearing assembly for use with a driven output shaft, the bearing assembly comprising first and second, axially spaced thrust bearing assemblies and a radial bearing assembly positioned between the thrust bearing assemblies.

These and further features and advantages of the present invention will become apparent from the following detailed description, wherein reference is made to the figures in the accompanying drawings.

BRIEF DESCRIPTION OF THE DRAWINGS

FIGS. 3A, 3B and 3C show an elevational view, partly in section and in greater detail of one embodiment of the present invention.

FIG. 4 is a plan view showing a typical thrust bearing for use in the present invention.

FIG. 5 is a view taking along the line 5-5 of FIG. 4.

DETAILED DESCRIPTION OF PREFERRED EMBODIMENTS

While the present invention will be discussed with particular reference to a downhole motor of the Moineau type, it will be understood that it is not so limited. The present invention can be used in virtually any type of downhole motor, including positive displacement motors (Moineau), turbo drills or any suitable motor arrangement for operation within a bore or other confined passage. Downhole motors typically comprise three major components—a motor section, a drive shaft section and an output shaft section. The motor section has a motor shaft, interconnected by the drive shaft section to the output shaft section. It is the output shaft section or assembly in downhole motors that is generally subjected to the greatest forces, be they lateral or thrust, and therefore utilize sophisticated bearing assemblies systems to accommodate those forces.

Figures 1A, 1B:
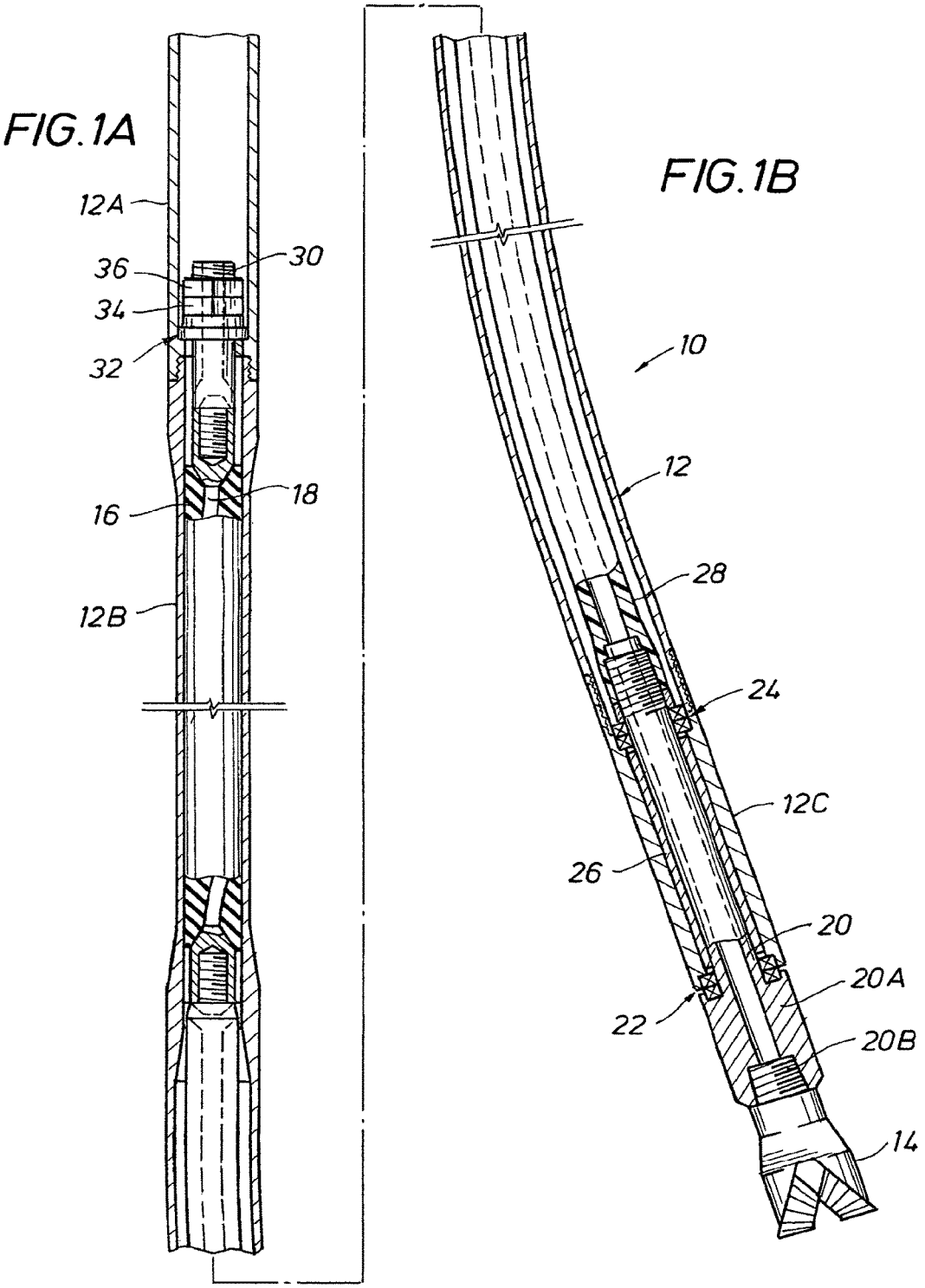
FIGS. 1A and 1B show an elevational view, partly in section, of one embodiment of the downhole motor of the present invention.

Referring first to FIGS. 1A and 1B, there is shown a downhole motor 10 according to one embodiment of the present invention. Downhole motor 10 has a housing 12 which, as can be seen from FIGS. 1A and 1B, is comprised of several sections, 12A, 12B, and 12C connected to one another, as by threads. In use in the drilling of oil wells, gas wells and other earth boreholes, the upper section 12A of the housing would be connected to the drill string while, as seen in Fig. IB, the lower end of the downhole motor is connected to a drill bit 14. While as shown, housing 12 is a bent housing commonly used to drill directional wells, and it will be understood that housing 12 could be a straight housing, particularly when it is desired to only drill generally vertical wells. As is typical of downhole motors, downhole motor 10 comprises a power section comprised of a stator 16, mounted in housing section 12B and a rotor 18 rotatably mounted in stator section 16. Further, and as is typical with all downhole motors, downhole motor 10 includes an output bearing section disposed in housing section 12C. The output bearing section comprises an output shaft 20, an "on-bottom" bottom thrust bearing assembly 22, an "off-bottom" thrust bearing assembly 24 and a radial bearing assembly 26 disposed between on-bottom thrust bearing assembly 22 and off-bottom thrust bearing assembly 24.

Output shaft 20 is connected to rotor 18 via a drive shaft assembly comprising a drive shaft 28 which, as shown in the embodiment of FIGS. 1A and 1B, is of a composite material. In this regard and, as noted above, housing 12 is of the bent housing design commonly used in directional drilling in oil and gas wells. Because the composite drive shaft 28 is quite flexible relative to metallic drive shafts, it can more readily bend through the arc of the bent housing 12 and typically does not require connecting joints such as U-joints, jaw clutch type joints, or CV-joints.

Referring to Fig. IA, it can be seen that rotor 18 has a first end portion 30 which extends out of stator 16 and which is positioned in housing 12 via a thrust bearing assembly shown generally as 32, thrust bearing assembly 32 being in compression via a threaded compression nut 34 and a threaded lock nut 36, both of which are received on the threaded end portion 30 of rotor 18.

Figures 2A, 2B:
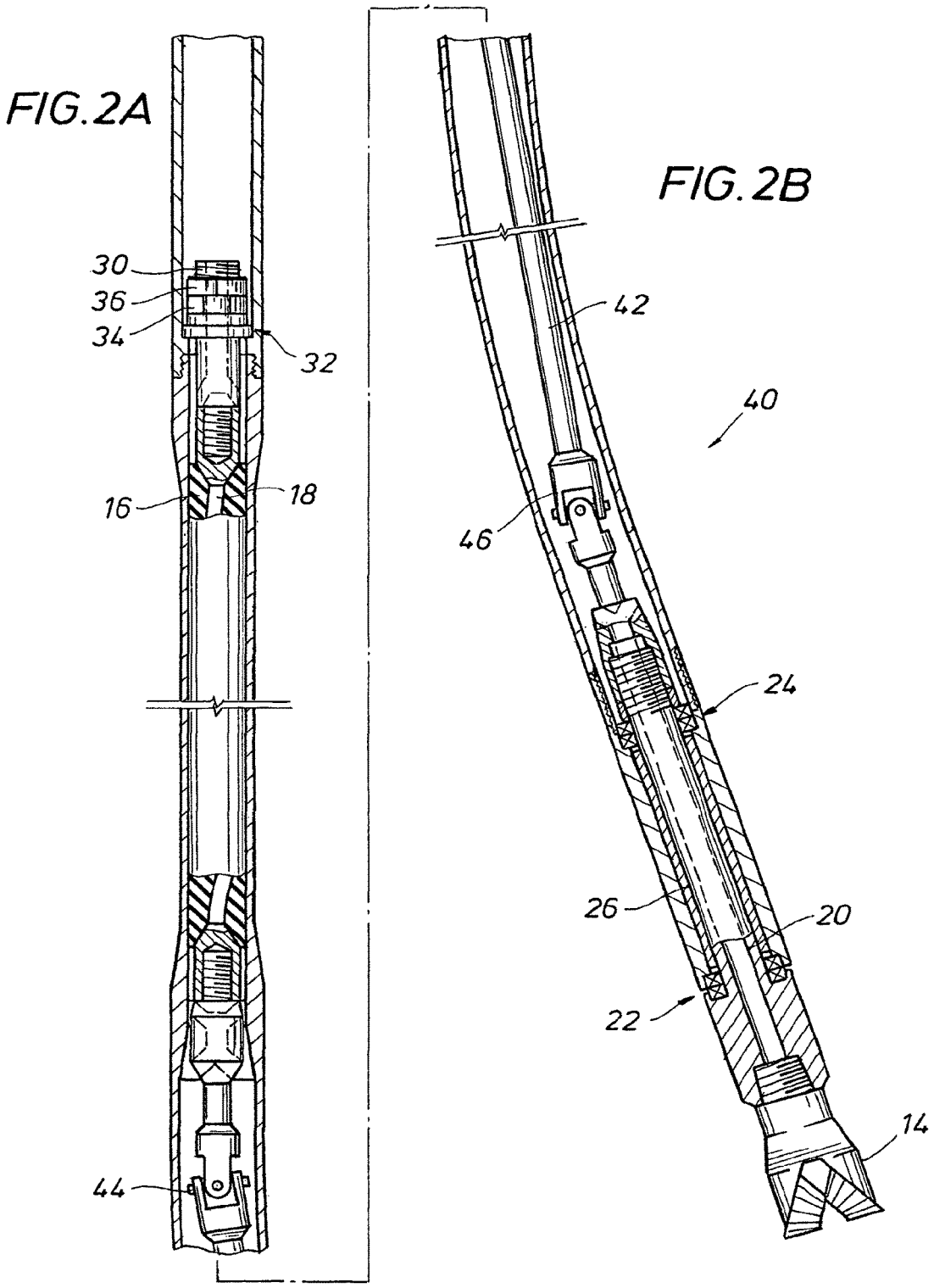
FIGS. 2A and 2B show a view similar to FIGS. 1A and 1B of another embodiment of the downhole motor of the present invention.

Referring now to FIGS. 2A and 2B, there is shown another embodiment of the downhole motor of the present invention. The downhole motor 40 shown in FIGS. 2A and 2B differs from downhole motor 10 shown in FIGS. 1A and 1B essentially in the type of drive shaft assembly interconnecting the motor section comprised of rotor 18 and stator 16 to the output shaft 20. In this regard and as can be seen from FIGS. 2A and 2B, drive shaft 42 is connected to rotor 18 via a first CV-joint or the like 44 and is also connected to output shaft 20 via a second CV-joint 46. Thus, metallic drive shaft 42 replaces composite drive shaft 28 and, since, as well known to those skilled in the art, metallic drive shafts do not have sufficient flexibility to bend through the art of bent housing 12, utilizing CV-joints 44 and 46 to accommodate the bend required by bent housing 12.

Figure 3A:
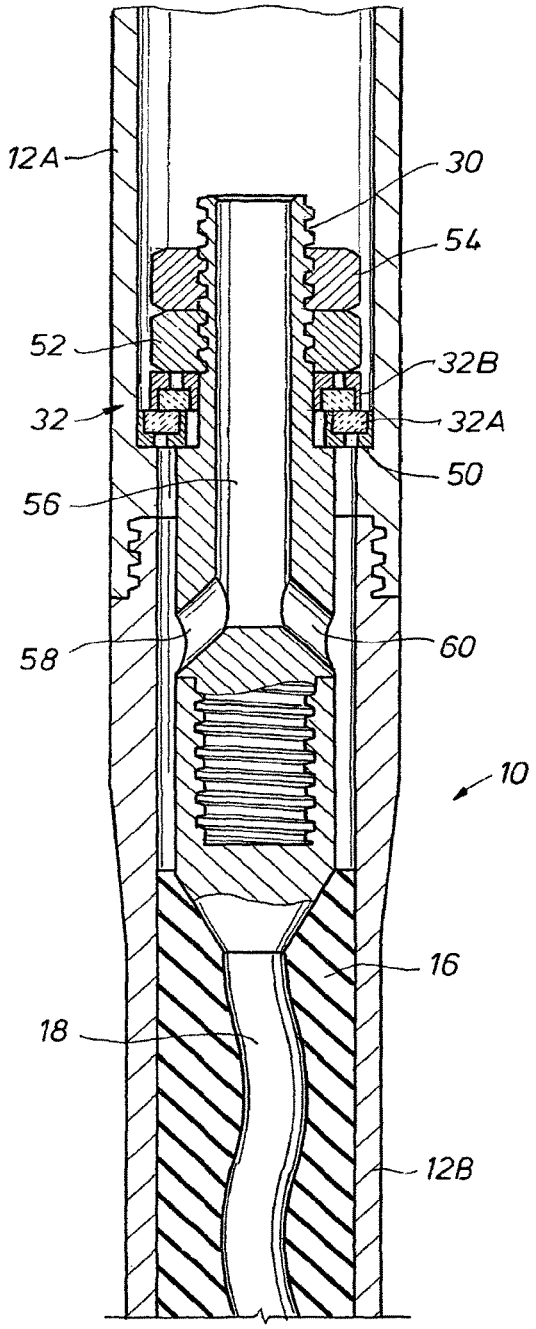
Figure 3B:
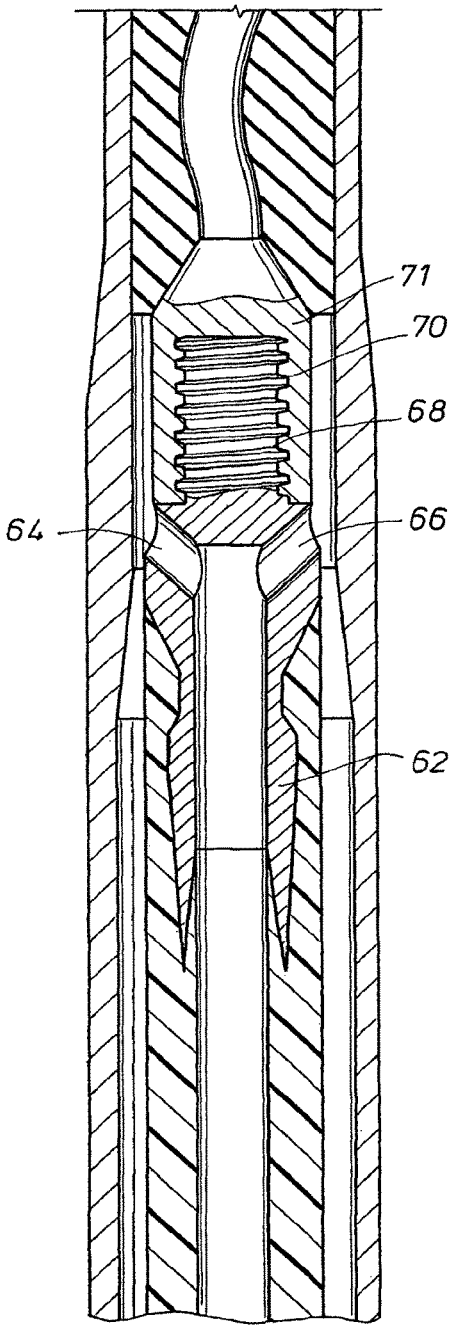

Referring now to FIGS. 3A, 3B, and 3C, there is shown in greater detail the downhole motor 10. Referring first to FIG. 3A, bearing assembly 32 comprises a stationary bearing 32A and the rotating bearing 32B. Stationary bearing 32A is in surrounding relationship to end portion 30 and is positioned on an annular shoulder 50 formed in housing 12. Rotating bearing 329, also in surrounding relationship to end portion 30, rotates with rotor 18. To compressively load rotating bearing 329 and stationary bearing 32A, a threaded nut 52 is received on the threaded end of end portion 30, threaded nut 52 cooperating with a lock nut 54 to maintain bearings 32B and 32A in the desired amount of compression. As will be appreciated, the combination of bearing assembly 32, shoulder 50 and nuts 52, 54, effectively hangs off rotor 18 so that thrust effects, particularly downward thrust by rotor 18 on composite drive shaft 28 is greatly reduced, if not neutralized since the downward thrust created by rotor 18 is now transmitted to shoulder 50 in housing 12. Drilling mud or other drilling fluids used to rotate rotor 18 is supplied through a longitudinal bore 56 through end portion 30 of stator 18, the drilling fluid passing through ports' 58 and 60 and down the length of downhole motor 10 to lubricate and cool the various bearings and bit 14.

As mentioned above, drive shaft 28 is made of a composite material. To this end, drive shaft 28 has a metallic sleeve 62 molded in drive shaft 28, sleeve 62 having ports 64 and 66 for downward flow of drilling fluid to drill bit 14, sleeve 62 having a threaded portion 68 received in a threaded box 70 formed in a second end portion 71 of rotor 18. In like fashion, composite drive shaft 28, at the opposite end, has a metallic sleeve 72 molded into composite drive shaft 28, sleeve 72 having a threaded box 74 in which is received the threaded end 76 of output shaft 20.

Off-bottom thrust bearing assembly 24 comprises a stationary bearing 24A positioned on an annular shoulder 80 in housing 12 and a rotating bearing 24B attached to and rotating with output shaft 20. On bottom thrust bearing assembly 22 comprises a stationary bearing 22A and a rotating bearing 22B. Bearings 24A and 24B, as well as bearings 22A and 22B are compressively urged towards one another by a third nut 84 received on a the threaded portion 76 of output shaft 20. Radial bearing pack 26, as noted above, is disposed between thrust bearing assembles 22 and 24. As best seen in FIG. 1B, output shaft 20 terminates in a bit box 20A, bit box 20A having a threaded box 20B for receipt of a drill bit 14. As shown, bit box 20A has an upwardly facing, annular recess 20C in which is received rotating bearing 22B.

It is a particular feature of the bearing assembly of the present invention that the on-bottom thrust bearing assembly has the rotating bearing positioned in or on the bit box, the stationary bearing being at least partially positioned in a housing, such that on-bottom thrust is accommodated proximal to the bit itself which permits a more stable operation vis-a-vis vibration.

In the description given herein, the term "proximal" means with respect to a relationship between the first and second members, the first member having a first and second end, that when the second member is said to be proximal the first end of the first member, it is closer to, but not necessarily at, the first end of the first member than the second end of the first member; thus, proximal is the opposite of "distal". By way of example, if the second member is closer to the first end of the first member than the second end of the first member, it is proximal the first end and distal the second end. Thus, proximal does not mean that the second member is necessarily at the first end of the first member.

In a drilling operation, drilling fluid is pumped down the drill string and through the downhole motor to rotate the drilling bit. The high pressure of the drilling fluids exerts a force downhole on the drilling motor that tends to push the drilling motor toward the bottom of the borehole. This force is commonly referred to as "off-bottom" thrust, since the pressure is strongest whenever drilling mud is pumped through the downhole drilling motor and the drill bit is off bottom of the borehole. Contact with the bottom of the borehole allows a portion of the offbottom thrust to be transferred to the bottom of the borehole, thereby lessening the off-bottom pressure borne by thrust bearings.

When the drill bit is in contact with the bottom of the borehole, the weight of the drill string exerts a force on the drill bit which is transmitted upwardly to the drilling motor to compress the drilling motor. This force is generally referred to as "on-bottom" thrust, since it is experienced only when the drill bit is in contact with the bottom of the borehole.

As can be seen, particularly with reference to FIG. 3C, the downhole motor of the present invention separates the thrust experienced by the drive section comprised of shaft 20 into an off-bottom thrust section accommodated by offbottom thrust bearing assembly 24 and an on-bottom thrust section accommodated by on-bottom bearing assembly 22. Thus, typically only a single radial bearing assembly 26 is required which results in a simplified output assembly carrying both thrust and radial loads. This is to be contrasted with prior art, downhole motors which typically require two or more sets of radial bearings in the output assembly. Thus, the arrangement shown in FIG. 3C substantially reduces the length of the output section of the downhole motor.

Referring now to FIG. 4, there is shown a plan view of a typical thrust bearing which can be used in the downhole motor of the present invention. It would be understood that various types of thrust bearings can be employed in the downhole motor of the present invention, the thrust bearing shown in FIGS. 4 and 5 being merely exemplary. Referring then to FIG. 4, the bearing, shown generally as 90, comprises an annular bearing pad carrier 92, having a series of concentrically disposed bearing pad recesses 94. Disposed in each of recesses 94 is a bearing pad 96 which, because of the environment, are generally made, of wear resistant material, such as, for example, a mixture of individual diamond crystals and particles of a pre-cemented carbide. For example, diamond pads 96 can be manufactured by subjecting diamond powder, powdered, precemented carbide or graphite and tungsten carbide to high heat and high pressure as well known to those skilled in the art. Polycrystalline bonds are formed between the diamond powder and the pre-cemented carbide particles to form a polycrystalline diamond surface on a tungsten carbide substrate. It will be appreciated that other constructions and materials may be employed to make bearing pads 96.

By separating the off-bottom and on-bottom thrust, a radial assembly, in accordance with the present invention, a drilling motor can be made wherein the output end proximate the drill bit is shorter in length than typical prior art downhole motors which have several radial bearing assemblies and hence require a longer length. Specifically, in prior art downhole motors, the practice is to position the off-bottom and on-bottom thrust bearings assemblies together, there being a radial bearing on one side of the thrust bearings and a radial bearing on the other side on the thrust bearings. This substantially extends the length of the lower end of the downhole motor.

Radial bearing 26 can take many forms; indeed, many radial bearings of various types designed for use with downhole motors are available.

It should also be understood that while reference is made, in the preferred embodiment, to there being only a single radial bearing assembly between the off-bottom and on-bottom thrust bearings, it will be understood that the word "single" is in the context of the only radial bearing assembly in the output section of the downhole motor, regardless of its construction or complexity, being disposed between the off-bottom and on-bottom thrust bearing assemblies.

Figure 6:
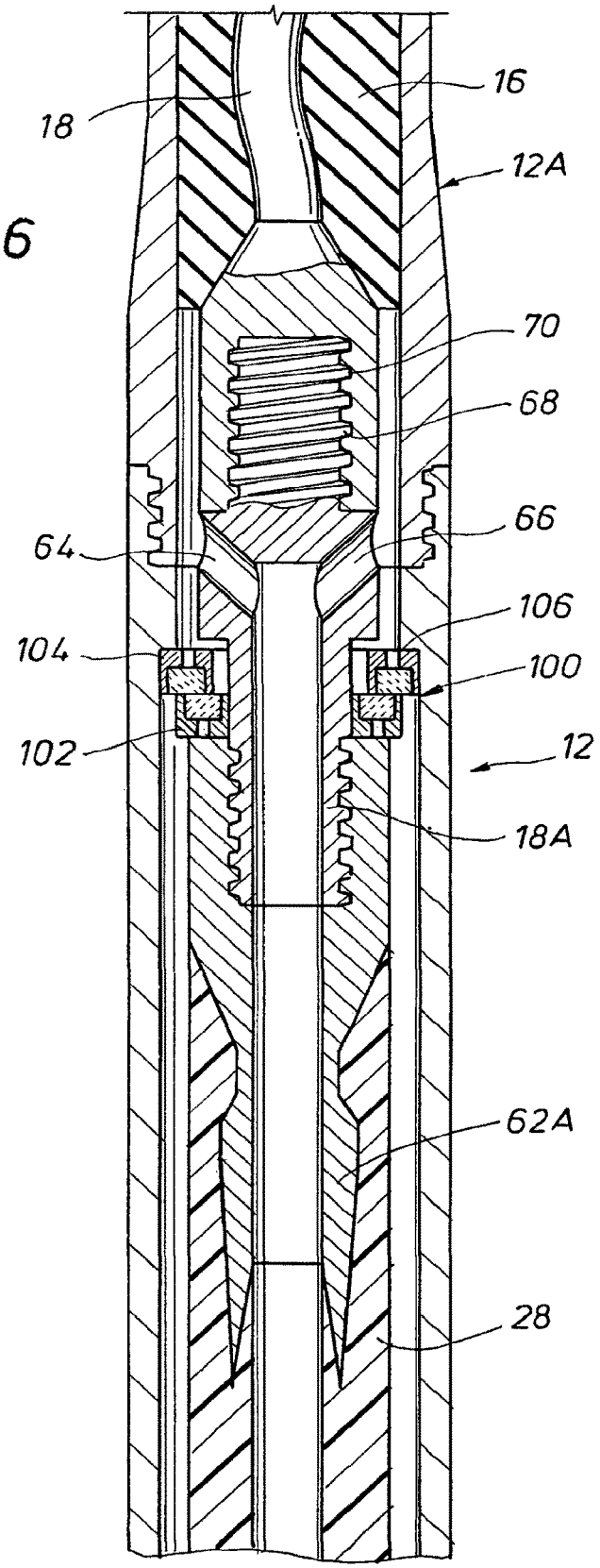
FIG. 6 is an elevational view, partly in section, of another embodiment of the present invention.

Referring now to FIG. 6, there is shown another embodiment of the present invention. The embodiment shown in FIG. 6 differs from that described above in that a thrust bearing assembly 100 is positioned in housing 12 and in surrounding relationship to a second end lower end portion 18A of rotor 18. As seen, thrust bearing assembly 100 includes a rotating bearing 102 and a stationary bearing 104, stationary bearing 104 being positioned against an annular shoulder 106 in housing 12. Rotating bearing 102 rotates with rotor 18, the lower end portion 18A, as seen, being threadedly connected to sleeve 62A molded in composite drive shaft 28.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A downhole motor comprising:

a housing, said housing having an annular inner wall and a first internal annular axially upwardly facing shoulder integrally formed in said housing on said inner wall;

a stator mounted in said housing, said stator having a first stator end and a second stator end; a rotor rotatably mounted in said stator, said rotor having a first rotor end portion extending out of said first stator end and a second rotor end portion extending out of said second stator end;

a first rotor end thrust bearing assembly in surrounding relationship to said rotor proximal said first rotor end portion, said first rotor end thrust bearing having a first rotor end rotating thrust bearing rotatable with said rotor and a first rotor end stationary thrust bearing positioned on said first shoulder in said housing and engagable with said first rotor end rotating thrust bearing;

an output shaft having a first output shaft end operatively connected to said rotor and a second output shaft end;

a first output shaft thrust bearing assembly in surrounding relationship to said output shaft and disposed proximal said first output shaft end, said first output shaft thrust bearing assembly having a first output shaft rotating thrust bearing rotatable with said output shaft and a first stationary output shaft thrust bearing in said housing and engagable with said first output shaft rotating thrust bearing;

a second output shaft thrust bearing assembly in surrounding relationship to said output shaft and disposed proximal said second output shaft end, said second output shaft thrust bearing assembly comprising a second output shaft rotating thrust bearing rotatable with said output shaft and a second output shaft stationary thrust bearing engagable with said second stationary thrust bearing; and a radial bearing assembly disposed in said housing in surrounding relationship to said output shaft and between said first and second thrust bearing assemblies.

2. The downhole motor of claim 1 wherein said output shaft is connected to a bit box, said second output shaft rotating thrust bearing being carried by said bit box.

3. The downhole motor of claim 2 wherein said bit box has an axially facing, annular recess and said second output shaft rotating thrust bearing is received in said recess.

4. The downhole motor of claim 2 wherein said first and second output shaft thrust assemblies comprise an annular carrier, said annular carrier having a series of circumferentially spaced, coaxial recesses, bearing pads being received in said recesses.

5. The downhole motor of claim 4 wherein said bearing pads comprise polycrystalline diamond.

6. The downhole motor of claim 1 wherein said housing has a second, internal annular axially downwardly facing shoulder integrally formed in said housing on said inner wall.

7. The downhole motor of claim 6 wherein there is a second rotor end portion thrust bearing assembly in surrounding relationship to said rotor proximal said second rotor end portion.

8. The downhole motor of claim 7 wherein said second rotor end thrust bearing assembly comprises a second rotor end rotating thrust bearing rotatable with said rotor and a second rotor end stationary thrust bearing positioned on said second shoulder in said housing and engagable with said second rotor end thrust bearing.

9. A downhole motor comprising:

a housing; said housing having an annular inner wall and a first axially upwardly facing annular shoulder integrally formed in said housing on said inner wall and a second axially downwardly facing annular shoulder integrally formed in said housing on said inner wall, a stator mounted in said housing, said stator having a first stator end and a second stator end;

a rotor rotatably mounted in said stator, said rotor having a first rotor end portion extending out of said first stator end and a second rotor end portion extending out of said second stator end;

an output shaft rotatably mounted in said housing and operatively connected to said rotor having a first output shaft end and a second output shaft end;

a first thrust bearing assembly in surrounding relationship to said output shaft and disposed proximal said first output shaft end, said first thrust bearing assembly having a first rotating thrust bearing rotatable with said output shaft and a first stationary thrust bearing engagable with said first rotating thrust bearing, said first stationary thrust bearing being positioned on said first shoulder;

a second thrust bearing assembly in surrounding relationship to said output shaft and disposed proximal said second output shaft end, said second thrust bearing assembly comprising a second rotating thrust bearing, and a second stationary thrust bearing engagable with said second rotating thrust bearing, said second stationary thrust bearing positioned on said second shoulder;

a radial bearing assembly disposed in said housing in surrounding relationship to said output shaft and between said first and second thrust bearing assemblies.

10. The downhole motor of claim 9, wherein said first and second thrust bearings comprise an annular carrier, said annular carrier having a series of circumferentially spaced, coaxial recesses, bearing pads being received in said recesses.

11. The downhole motor of claim 10 wherein said pads comprise polycrystalline diamond.

12. A down-hole motor comprising:

a motor section, comprising:

a motor housing, a motor shaft rotatably mounted in said motor housing;

an output shaft section comprising:

an output shaft housing, said output shaft housing having an annular inner wall a first axially upwardly facing annular shoulder integrally formed in said housing on said inner wall and a second axially downwardly facing annular shoulder integrally formed in said housing on said inner wall;

an output shaft rotatably mounted in said output shaft housing, said output shaft having a first output shaft end and a second output shaft end, said first output shaft end of said output shaft being operatively connected to said motor shaft, said output shaft section further including:

a first output shaft thrust bearing assembly in surrounding relationship to said first output shaft end proximal said first end of said output shaft, said first output shaft bearing assembly comprising a first output shaft rotating thrust bearing rotatable with said output shaft and a first output shaft stationary thrust bearing engagable with said first output shaft rotatable thrust bearing, said first output shaft stationary thrust bearing being positioned on said first shoulder;

a second output shaft thrust bearing assembly in surrounding relationship to said output shaft proximal said second end of said output shaft, said second output shaft thrust bearing assembly comprising a second output shaft rotating thrust bearing rotatable with said output shaft and a second output shaft stationary thrust bearing engagable with said second output shaft rotating thrust bearing, said second output shaft stationary bearing being positioned on said second shoulder;

a radial bearing assembly positioned between said first and second output shaft bearing assemblies and in surrounding relationship to said output shaft.

13. A down-hole motor comprising:

a motor section, said motor section comprising:

a motor housing, said motor housing having an annular inner wall and a first internal annular axially upwardly facing shoulder integrally formed in said housing on said inner wall and an axially spaced, second internal annular axially downwardly facing shoulder integrally formed in said housing on said inner wall; and a motor shaft rotatably mounted in said motor housing, said motor shaft having a first motor shaft end and a second motor shaft end;

a first motor shaft thrust bearing assembly in surrounding relationship to said motor shaft proximal said first motor shaft end, said first motor shaft thrust bearing assembly comprising a first motor shaft rotatable thrust bearing rotatable with said motor shaft and a first motor shaft stationary thrust bearing positioned on said first shoulder and engagable with said first motor shaft rotatable thrust bearing;

a second motor shaft thrust bearing assembly in surrounding relationship to said motor shaft proximal said second motor shaft end, said second motor shaft end thrust bearing assembly comprising a second motor shaft rotatable bearing rotatable with said motor shaft and a second motor shaft stationary bearing positioned on said second shoulder and engagable with said second motor shaft rotatable bearing;

an output shaft section comprising:

an output shaft housing an output shaft rotatably mounted in said output shaft housing, said output shaft having a first output shaft end and a second output shaft end, said first output shaft end of said output shaft being operatively connected to said motor shaft, said output shaft section further including:

a first output shaft thrust bearing assembly in surrounding relationship to said first output shaft proximal said first output shaft end of said output shaft, said first output thrust bearing assembly comprising a first output shaft rotating thrust bearing rotatable with said output shaft and a first output shaft stationary thrust bearing engagable with said first output shaft rotatable thrust bearing;

a second output shaft thrust bearing assembly in surrounding relationship to said output shaft proximal said second end of said output shaft, said second output shaft thrust bearing assembly comprising a second output shaft rotating thrust bearing rotatable said output shaft and a second output shaft stationary thrust bearing engagable with said second output shaft rotating thrust bearing;

a radial bearing assembly positioned between said first and second output shaft bearing assemblies and in surrounding relationship to said output shaft.

* * * * *